US005603647A

United States Patent [19]

Van Adrichem et al.

[11] Patent Number: 5,603,647

[45] Date of Patent: Feb. 18, 1997

[54] INFLATABLE LIFE PRESERVING FLOATATION DEVICE FORMED FROM DOUBLE WOVEN TEXTILE FABRICS

[75] Inventors: Aad Van Adrichem, Prestbury; Chris P. Kavanagh, Mossley, both of United Kingdom

[73] Assignee: Reeves Brothers, Inc., Spartanburg, S.C.

[21] Appl. No.: 395,773

[22] Filed: Feb. 28, 1995

[51] Int. Cl.[6] ..... B63C 9/08

[52] U.S. Cl. ..... 441/106; 441/117

[58] Field of Search ..... 441/106, 88, 108, 441/111–119, 123, 129; 114/345

[56] References Cited

U.S. PATENT DOCUMENTS

| | | | |
|---|---|---|---|
| 1,850,660 | 3/1932 | Coppel | 441/118 |
| 2,742,654 | 4/1956 | Hurt | 441/118 |
| 3,736,610 | 6/1973 | Frieder | 441/112 |
| 3,935,607 | 2/1976 | Cantwell et al. | 114/345 |
| 4,193,153 | 3/1980 | Tyrer et al. | 9/342 |
| 4,462,331 | 7/1984 | McCrory | 114/345 |
| 5,010,663 | 4/1991 | Thornton et al. | 38/52 |
| 5,011,183 | 4/1991 | Thornton et al. | 280/743 |
| 5,030,153 | 7/1991 | Bailey | 441/106 |
| 5,073,418 | 12/1991 | Thornton et al. | 428/34.9 |
| 5,098,125 | 3/1992 | Thornton et al. | 280/743 |
| 5,152,706 | 10/1992 | Fister | 441/106 |

*Primary Examiner*—Stephen Avila
*Attorney, Agent, or Firm*—Pennie & Edmonds

[57] ABSTRACT

The present invention is related to a novel inflatable floatation device and a method of forming the same. The device is formed of a one piece double woven fabric having first and second layers which are separable from each other to form a chamber capable of accepting and retaining a gas from an inflation device. The first and second layers are formed by using warps and wefts of yarn that interlace with each other in such a manner as to form separate layers of fabric. The two separate layers of fabric are joined at the periphery of the device via an alteration of the warp and weft interlacing sequence which forms an outer margin. The fabric may be coated with an elastomeric or thermoplastic material to ensure the device is air and water tight.

21 Claims, 2 Drawing Sheets

INFLATABLE LIFE PRESERVING FLOATATION DEVICE FORMED FROM DOUBLE WOVEN TEXTILE FABRICS

TECHNICAL FIELD

This invention relates generally to the manufacture of a life preserving inflatable floatation device. In particular, the invention relates to an inflatable life preserving floatation device that is formed from a double woven textile fabric and a method for forming the same.

BACKGROUND OF THE INVENTION

A variety of manufacturing methods exist for the production of inflatable floatation devices. Typically, a life preserving device is manufactured in such a configuration that enables the device to be put on over and around an individuals body in order to provide buoyancy and keep the individual afloat.

Such devices are usually constructed by joining a front panel and a rear panel of a singly woven fabric at their peripheries, thus forming a chamber. The chamber is capable of being inflated with a gas from a compressed gas container or some other inflation device in order to provide buoyancy.

The front and rear fabric panels may be joined by a variety of methods. Such joining mechanisms include heat set gluing, ultra-sonic welding or vulcanizing to permanently join the front and rear fabric panels. Methods such as those above typically result in a continuous seam around the outer periphery of the floatation device.

In many life preserving devices, it is desirable to also have a belt or a tying mechanism. Sewing of such additional features further necessitates a need for additional sealing around the sewing areas to prevent leakage of the inflating gas.

As a result of the variety of processes required in order to join the fabrics, as well as to provide belts or other fastening mechanisms, the floatation devices of the prior art typically require a number of steps in their production and manufacture. These added production steps complicate the manufacture of such devices and result in increased production costs.

Furthermore, the seam resulting from the various joining mechanisms can provide a structurally weakened area, increasing the potential for leakage of the inflation medium from the chamber of the device, thereby reducing the reliability of such floatation devices.

SUMMARY OF THE INVENTION

The present invention provides a seamless floatation device which is easily manufactured, having a decreased number of production steps, and accordingly, lower manufacturing costs than those of the background art.

The present invention is a novel inflatable floatation device which is formed of a one piece double woven fabric which comprises first and second layers which are separable from each other to form a chamber capable of accepting and retaining a gas from an inflation device. The first and second layers are formed by using warps and wefts of yarn that interlace with each other in such a manner as to form separate layers of fabric. The two separate layers of fabric are caused to merge at their peripheries via an alteration of the warp and weft interlacing sequence. A means for inflating the device is attached to one of the fabric layers.

The interlacing of the warp and weft yarns can be controlled by programming the weaving technique, preferably using a computer controlled jacquard weaving loom. Additionally, straps may be integrally woven or otherwise attached to the body of the floatation device. Furthermore, the interlacing of the warp and weft sequence may be modified to furnish lugs for attaching the securing straps, or alternatively may provide for slitting in order to accommodate an additional belt or securing strap.

The floatation devices of the present invention are obtained from a roll of a one piece fabric which contains a plurality of such devices integrally woven therein. The roll of doubly woven fabric containing the individual floatation devices can be coated or subjected to another sealing process on the top and bottom of the fabric in order to ensure that both outer surfaces of the floatation devices are air and water tight. Subsequent to the coating process, the individual floatation devices will be cut from the fabric roll using a cutting method such as die-cutting, laser, water jet or ultrasonic cutting process. Optionally, after the devices are cut from the fabric roll, each device may be turned inside out through a hole provided for the inflating means so as to position the coated layer in the interior of the device and a fabric surface on the exterior of the device.

DETAILED DESCRIPTION OF THE INVENTION

The present invention relates to an inflatable floatation device formed of a one piece woven fabric and a method of forming the same.

Figure 1:
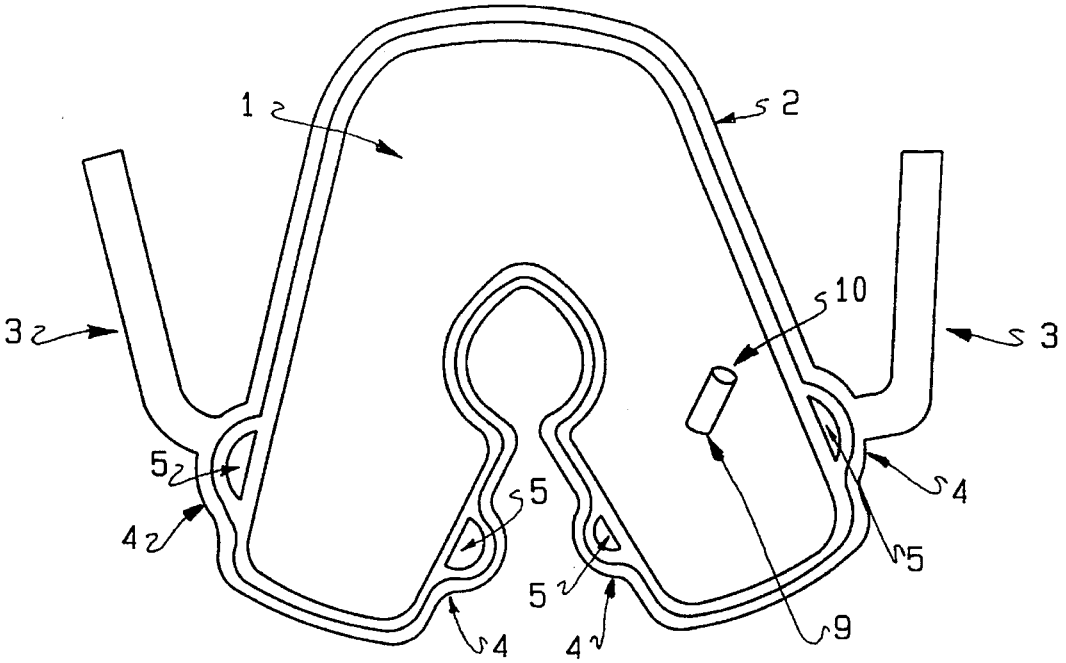
FIG. 1 is a front elevational view of a floatation device in accordance with the present invention.
Figure 2:
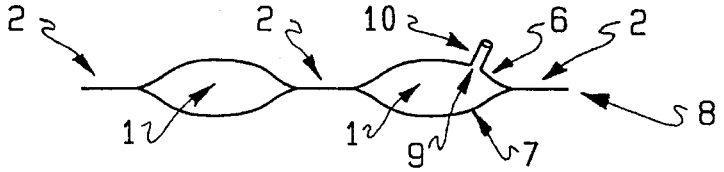
FIG. 2 is a cross-sectional front view of a floatation device in accordance with the present invention illustrating the separable first and second fabric layers of the one piece woven fabric.

FIGS. 1 and 2 illustrate a seamless inflatable floatation device of the present invention. The floatation device of the present invention comprises a one piece woven fabric 8. The one piece woven fabric 8 has separable, opposed first 6 and second 7 fabric layers. The fabric layers are woven together at an outer margin 2 to define a chamber 1 for accepting an inflation medium. A coating (not shown) may be provided for the fabric layers in an amount sufficient to retain the inflation medium in the chamber.

If desired, a variety of tying mechanisms may be incorporated into the floatation device of the present invention. A plurality of straps 3 may be integrally woven or otherwise attached to the outer margin 2 of the floatation device. Likewise, a plurality of lug members 4 may be provided for attachment of additional securing straps. The lug members may be provided with a loosely woven area 5 of two fabric layers which may subsequently be slit in order to accommodate additional securing straps.

The devices of the present invention may be formed in any desired shape suitable for use as a floatation device. FIG. 1 illustrates a preferred embodiment of the present invention, wherein the floatation device is configured in an inverted U-shape.

Figure 3:
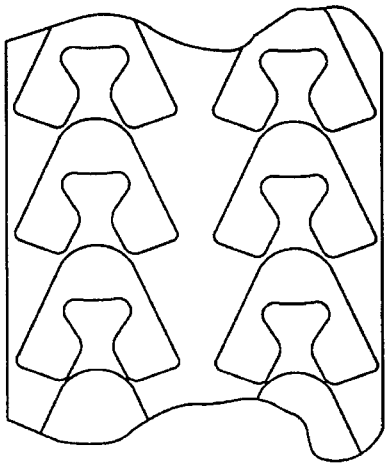
FIG. 3 is a front elevational view of a roll of one piece fabric in which a plurality of floatation devices of the present invention are woven therein.

The floatation device of the present invention is obtained from a roll of a one piece fabric which contains a plurality of such devices integrally woven therein. The quantity and configuration of the floatation devices woven within the roll of fabric is determined by the desired shape and size of the devices. FIG. 3 illustrates a preferred configuration of a plurality of the preferred U-shaped floatation devices. As illustrated in FIG. 3, it is desirable to place the devices in such a configuration so as to optimize the number of devices per quantity of fabric. Additionally, the configuration of the devices in the fabric may also be necessarily dependent upon the specifications of the loom upon which the fabric is woven such as the maximum fabric width, the number of hooks in the jacquard and the tie pattern.

The woven fabric of the present invention is formed by interlacing the warps and wefts of a yarn material by means of a weave pattern. The art of weaving is well developed and a skilled artisan would be able to readily determine suitable weave patterns for a fabric which is to be employed in forming a floatation device. The preferred weave patterns for the present invention include plain, hopsack or twill weaves. A most preferred weave pattern is the double layer twill weave illustrated in FIG. 4.

Figure 4:
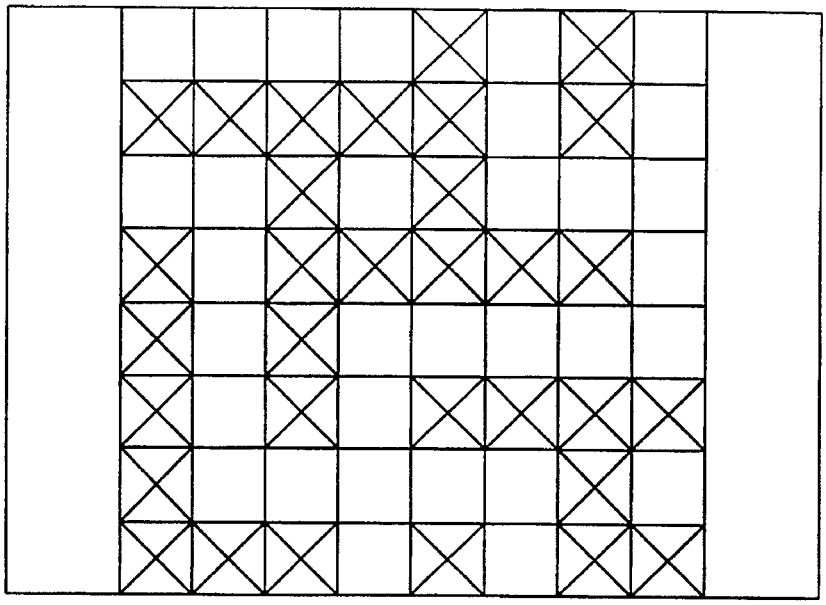
FIG. 4 illustrates the preferred double layer twill weave pattern of the one piece fabric of which the present invention is comprised.

The double layer twill weave is illustrated in FIG. 4 using a conventional square design graph. The vertical running squares correspond to the warps and the horizontal running squares represent the wefts. It is customary in the weaving art to indicate that a particular warp yarn goes over a given weft yarn by marking the corresponding square with an X. Likewise, a blank indicates that the warp goes under the weft. The weave pattern is repeated in each direction.

The warps and wefts of the woven fabric may be selected from a variety of suitable yarn materials including synthetic materials such as polyamides and polyesters. Preferred polyamide materials include Nylon 6 and Nylon 6—6. A preferred polyester material is polyethylene terephthalate ("PET").

One of skill in the textile art would readily be able to determine the appropriate denier for the particular yarn material selected. For polyamide yarn, a denier of about 210–840 is used, while for polyester yarn, a denier of about 220–1000 is used. Depending upon the particular filament or yarn used, the denier can be between about 200 and 1200.

Figure 5:
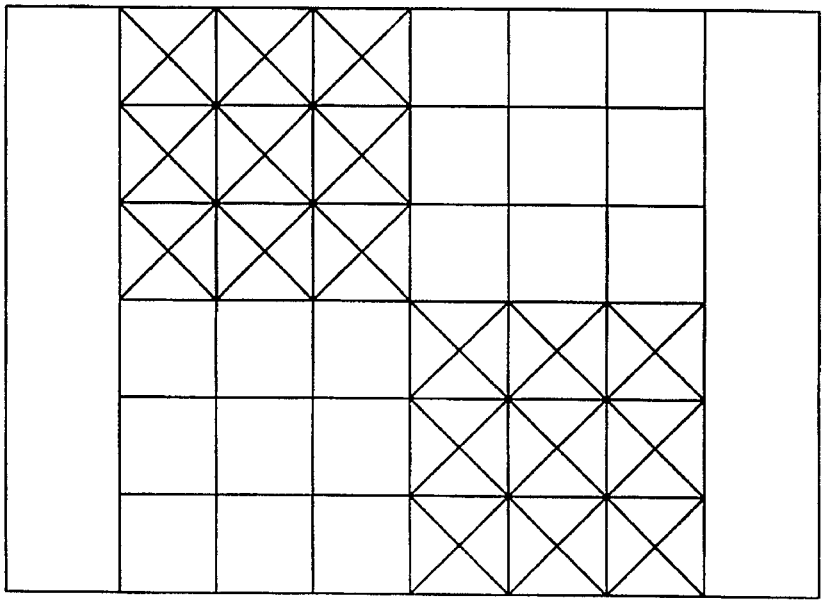
FIG. 5 illustrates the preferred double weave for interlacing the separable fabric layers of the one piece fabric to form the outer margin.

In order to provide a seamless floatation device, the first and second fabric layers are interwoven at an outer margin so as to form a fabric chamber for accepting an inflation medium. The art of weaving is well developed and the fabric layers may be interwoven using any suitable weaving technique. In a preferred embodiment of the invention, the layers are woven together by the hopsack weave pattern shown in FIG. 5. As discussed above with regard to FIG. 4, the hopsack weave pattern of FIG. 5 is illustrated using a conventional square design diagram. The X's indicate the warp is going over the weft, while a blank indicates that the warp is going under the weft.

Due to the stresses created when the floatation device is inflated and subsequently utilized, the fabrics employed in forming the devices of the present invention must impart a certain degree of strength to these devices. The fabrics employed in the present invention should have a strength of at least about 300 lbs. per square inch. Typically, fabric strengths of about 350–400 lbs. per square inch are utilized.

A hole must be provided in one of the fabric layers in order to accommodate an inflating means such as a valve or other inlet device. A variety of methods may be employed to form the hole. In one method embodiment of the invention, subsequent to weaving, the fabric layers are separated a suitable distance from one another and a hot blade is used to cut the hole in one of the layers.

Additionally, if it is desired, straps for securing the floatation device of the present invention can be provided. Securing straps can be integrally woven in to the floatation device at the outer margin of the device. Alternatively, the securing straps may be attached separately by sewing or some other attaching means. Lug members for attaching the securing straps may also be woven integrally in the fabric. Furthermore, apertures may subsequently be provided in the lug members for accommodating a securing strap or belt.

A variety of conventional looms can be used to interweave the warps and wefts to form a one piece fabric of a desired weave pattern. A jacquard weaving loom is preferred. Even more preferred is a jacquard loom in which the warp and weft sequencing is computer controlled.

After the fabric is woven, but before the individual devices are cut from the roll of fabric, a coating is provided to the outer surfaces of the fabric in order to ensure that the floatation devices of the present invention are both air and water tight. The coating also has the added benefit of reducing fraying of the fabric when the individual devices are cut from the fabric roll. Suitable coatings include a variety of elastomeric or thermoplastic resins, with neoprene and polyurethane being preferred. The coating material is provided in an amount sufficient to ensure that the fabric is air and water tight. In a preferred embodiment of the invention, each side of the fabric is coated with about 7 ½ ounces per square yard of neoprene rubber. The fabric coating can vary from about 2 to 15 ounces per square yard, depending upon the specific coating material used and the base fabric weave structure.

Additionally, the coating can also include a variety of other agents such as anti-bacterial and mildew resistant agents to improve the wear and aging characteristics of the devices. Further, safety enhancing additives such as flame resistant agents may also be included in the coating.

Any number of methods may be employed to apply the coating to the fabric of the invention. One of skill in the textile art would be able to select an appropriate application method based upon the coating material to be applied. Examples of suitable coating methods include dipping, impregnating, knife coating, spraying, calendering with pressure and spread coating. In a preferred embodiment of the present invention, the neoprene coating is applied by a spread coating process.

After the roll of fabric has been coated, the individual floatation devices are removed from the fabric roll using a suitable cutting method. A variety of cutting methods including die-cutting, a laser cutting process, water-jet cutting or an ultrasonic cutting process may be utilized. In a preferred embodiment of the present invention, a laser cutting system fitted with a vision system that is capable of recognizing and following the design of the outer margin of the floatation device is employed to automatically cut the devices from the fabric roll.

A means for inflating the device such as a valve is conventionally attached to the area of the fabric layer having the previously formed hole. However, it may be desirable to have the coated surface of the fabric on the interior and a fabric surface on the exterior of the floatation device. Accordingly, prior to attaching an inflating means, the device is inverted or turned inside out through the hole, positioning the coated surface in the interior of the device. A means for inflating the device is then attached to the area of the fabric layer having the hole.

From the above described floatation device and method of manufacturing thereof, it will be appreciated that a significant advantage of the present invention is a reduction in the number of production steps which results in a decrease in manufacturing costs. An additional advantage of the floatation device of the present invention is its seamless nature, which removes the potential for leakage that can result from the inferior joining mechanisms of the background art.

What is claimed is:

1. An inflatable floatation device comprising a double cloth woven fabric having separable, opposed first and second fabric layers having outer and inner surfaces which are woven together at an outer margin to define a chamber for accepting an inflation medium, and a coating on the outer surface of the fabric layers and the outer margin in an amount sufficient to prevent air from passing therethrough to thus retain the inflation medium in the chamber; wherein said fabric includes an aperture and the chamber is inverted through the aperture to place the coating in contact with the inflation medium.

2. The device of claim 1 wherein the coating is an elastomeric or thermoplastic material.

3. The device of claim 1 wherein said aperture is configured and dimensioned for accommodating an inflating means.

4. The device of claim 1 which further comprises at least one strap member.

5. The device of claim 1 which further comprises a plurality of lug members.

6. The device of claim 5 wherein each lug member includes an aperture.

7. The device of claim 1 wherein said woven fabric comprises a plain, hopsack or twill weave using yarns having a denier of between about 200 and 1200 so that the fabric has a strength of at least about 300 pounds per square inch.

8. The device of claim 1 wherein the coating is present in an amount of between about 2 and 12 ounces per square yard of fabric.

9. An inflatable floatation device comprising a double cloth woven fabric having separable, opposed first and second fabric layers having outer and inner surfaces which are woven together at an outer margin to define a chamber for accepting an inflation medium, a plurality of straps woven onto the outer margin, and a coating on the outer surface of the fabric layers and the outer margin in an amount sufficient to prevent air from passing therethrough to thus retain the inflation medium in the chamber.

10. A method for making an inflatable floatation device which comprises:

weaving first and second fabric layers which are separated from other;

interlacing the layers in predetermined portions representative of a desired shape to form an outer margin around a portion of the first and second fabric layers to define a chamber having inner and outer surfaces formed by the fabric layers;

applying a coating upon the outer surfaces of the chamber and the outer margin in an amount sufficient to prevent air or water from passing through the fabric layers; and cutting the chamber adjacent to the outer margin to obtain an inflatable floatation device which is capable of retaining an inflation in the chamber.

11. The method of claim 10 which further comprises weaving strap members onto the outer margin.

12. The method of claim 10 which further comprises providing lug members on the outer margin of the device.

13. The method of claim 12 which further comprises attaching strap members to the lug members.

14. The method of claim 12 wherein the lug members are provided with apertures.

15. The method of claim 10 wherein the coating comprises a thermoplastic resin or an elastomer and is applied by spread coating, dipping, impregnating, knife coating, spraying or calendering the fabric.

16. The method of claim 10 wherein the chamber is cut out using a die cutting, laser cutting, water-jet or ultrasonic cutting process.

17. The method of claim 10 which further comprises providing the chamber with an aperture for allowing entry of an inflation medium.

18. The method of claim 17, which further comprises inverting the device through the aperature.

19. The method of claim 10 wherein the fabric is woven in a plain hopsack or twill weave using yarns having a denier of between about 200 and 1200 so that the fabric has a strength of at least about 300 lbs. per square inch.

20. A method for making an inflatable floatation device which comprises:

weaving first and second fabric layers which are separated from each other;

interlacing the layers in predetermined portions representative of a desired shape to form an outer margin around a portion of the first and second layers to define a chamber having inner and outer surfaces formed by the fabric layers;

applying a coating upon the outer surfaces of the fabric layers and the outer margin in an amount sufficient to prevent air or water from passing through the fabric layers;

cutting the chamber adjacent to the outer margin;

providing an aperture in one of the coated fabric layers; and inverting the chamber through the aperture to form an inflatable floatation device with a coating on the internal surfaces of the chamber.

21. The inflatable floatation device produced by the method of claim 20.

* * * * *